United States Patent [19]

Geyer

[11] 4,000,931

[45] Jan. 4, 1977

[54] RAILWAY CAR CENTER PLATE AND AUXILIARY RESILIENT BEARINGS

[75] Inventor: Robert P. Geyer, Palatine, Ill.

[73] Assignee: Standard Car Truck Co., Chicago, Ill.

[22] Filed: July 25, 1975

[21] Appl. No.: 598,936

[52] U.S. Cl. ..... 308/138; 105/199 CB

[51] Int. Cl.[2] ..... B61F 5/08; B61F 5/14; B61F 5/16; F16C 17/04

[58] Field of Search ..... 105/199 C, 199 CB; 267/3, 4; 308/137, 138

[56] References Cited

UNITED STATES PATENTS

| | | | |
|---|---|---|---|
| 3,533,359 | 10/1970 | Williams | 267/3 X |
| 3,845,725 | 11/1974 | Gierlach | 267/4 |

*Primary Examiner*—Robert J. Spar
*Assistant Examiner*—Howard Beltran
*Attorney, Agent, or Firm*—Kinzer, Plyer, Dorn & McEachran

[57] ABSTRACT

A railroad car bolster with provision for elastomeric cushions or pads on each side of the bolster center plate. The pads are mounted in retainers. The side walls of the retainers extend upwardly from the bolster and have substantially continuous uninterrupted upper surfaces. The pads positioned within the retainers have elongated slots which extend along and are slightly spaced from the retainer side walls. Fastening members, in the form of angles, are welded to each retainer side wall, and have a portion thereof which extends along the flat upper surface of the side wall and into the pad slots to thereby secure the pads within the retainers.

1 Claim, 4 Drawing Figures

RAILWAY CAR CENTER PLATE AND AUXILIARY RESILIENT BEARINGS

SUMMARY OF THE INVENTION

The present invention relates to railroad car truck bolsters and in particular to an improved means for securing elastomeric cushions or pads in bolster retainers.

One purpose of the invention is a means for securing a bolster pad within its retainer or pocket which will accomodate a varying number of shims but still provide full welding surfaces for the securing members.

Another purpose is a bolster retainer pocket having substantially continuous upper side wall surfaces which accomodate a securing angle at various positions along the side wall.

Another purpose is a structure of the type described in which the bolster pad or cushion has an elongated slot to receive the securing member which is in turn fastened to the retainer side wall.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
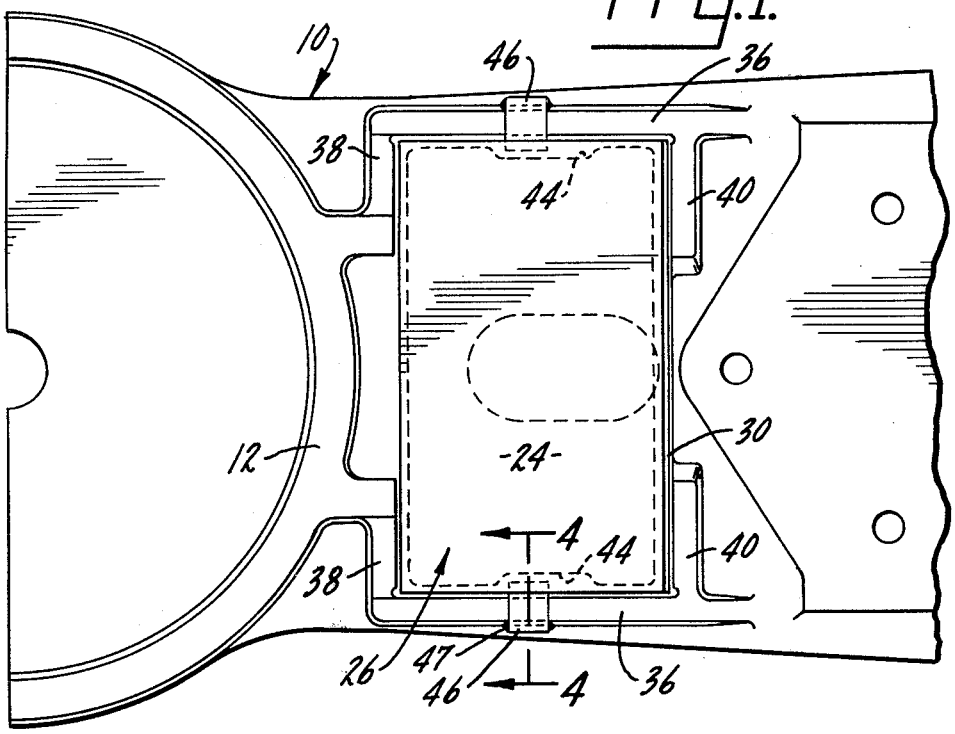
FIG. 1 is a partial top view of a truck bolster.

U.S. Pat. Nos. 3,845,725 and 3,533,359 both show elastomeric cushions or pads which are positioned between the car bolster and the truck bolster to restrain rocking movement of the car. The pads are either bolted to the car or positioned within retainers or pockets which are integral with the bolster top surface. The present invention is particularly directed to an improved means for securing the pads within the retainers.

In prior constructions, such as that shown in U.S. Pat. No. 3,845,725, there was a slot in the upper portion of the retainer side wall to accomodate a stop pin which was welded to the retainer side wall and extended into a slot within the pad. However, different shim conditions necessary to provide the appropriate preload between the truck and car bolster at times did not provide sufficient wall surface to adequately weld the securing stop pin to the slot in the retainer side wall. The present invention overcomes this problem by eliminating the side wall slot which received the securing stop pin and at the same time elongating the pad slot to accomodate various positions of the angle due to different shim conditions within the retainer.

Only a portion of the truck bolster is shown. However, as is understood in the art, there will be similar pads on each side of the bolster center plate. Bolster 10 has a typical center plate female rim 12 which will accomodate male center plate member 14. The car body bolster 18 mounts a spacer 20 (if needed) by means of bolts or the like 22. A wear plate 27 may be attached to the bottom surface of spacer 20 and will bear against the upper surface 24 of a pad 26. Pad 26 may be of conventional construction and will include a cushion 28 of a rubberlike or elastomeric material sandwiched between an upper wear plate 30 and a lower wear plate 32. There will be shims 52 (FIG. 4) positioned between the lower surface of wear plate 32 and retainer bottom wall 31.

Each pad 26 is positioned within a pocket or retainer 34. The retainer 34 may have side walls 36, laterally extending inboard end walls 38 and laterally extending outboard end walls 40. Conventionally, the pad will be of a size and shape to fit easily within pocket 34.

The top or upper surface 42 of each side wall is substantially continuous and uninterrupted, in contrast to the prior art construction described above.

Opposite sides of pad 26 have elongated slots 44 positioned intermediate the pad opposite ends and extending a distance substantially greater than the width of fastening member or angles 46. Thus, since there will be varying numbers of shims placed between wear plate 32 and the bottom of pocket 34, each angle 46 may be variably positioned along the upper surface 42 of side wall 36 and still be positioned within slots 44.

Figure 4:
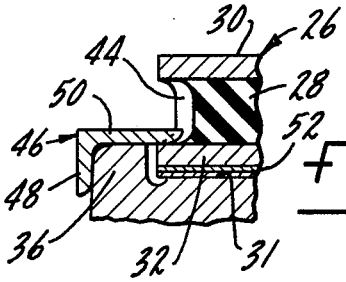
FIG. 4 is a section along plane 4—4 of FIG. 1.

As particularly shown in FIG. 4, angles 46 are somewhat L-shaped having a shorter arm 48 and a longer arm 50. Arm 48 will be welded to side wall 36, as at 47, whereas arm 50 will lie on top of side wall 36 along surface 42 and extend into slot 44.

Figure 2:
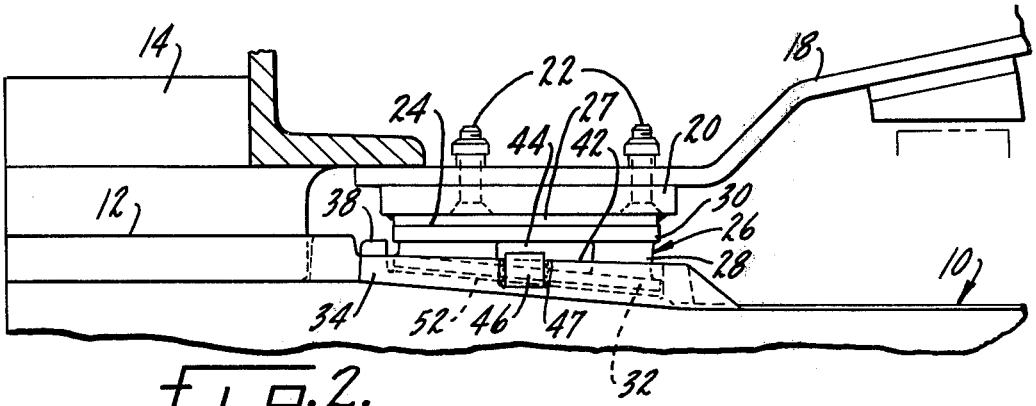
FIG. 2 is a partial side view of the car and truck bolsters.
Figure 3:
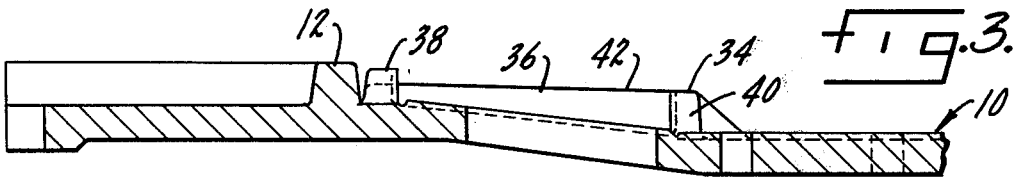
FIG. 3 is a side view of the bolster, with the pad removed.

The number of shims 52 which are necessary to provide the appropriate position of pad 26 relative to car bolster 18 and its spacer 20 and wear plate will determine the height of the pad above retainer bottom wall 31. If a large number of shims are to be used, in order to provide adequate and full welding area between arm 48 and side wall 36, angle 46 will be moved outboard, or over to the right, as illustrated in FIG. 2. On the other hand, if there were a lesser number of shims, permitting pad 26 to be positioned lower within the retainer 34, then angle 46 will be moved to the left or inboard. Thus, the angle can be variably positioned along side wall 36 and its upper surface 42 and still provide a full welding area between angle arm 48 and wall 36. The elongated slot with the angle on top of the retainer wall permits variable positioning of angle 46, whereas, the bolster retainer slot and pin of the prior construction only permitted a restricted location for the pin with poor bearing for welding. The present invention can thus accomodate various shim conditions and still provide full welding area for the angles which secure the pads within the retainer pocket.

Whereas the preferred form of the invention has been shown and described herein, it should be realized that there may be many modifications, substitutions and alterations thereto.

The embodiments of the invention in which an exclusive property or privilege is claimed are defined as follows:

1. A railroad car bolster including spaced pad retainers positioned on either side of the bolster center plate area, each of said pad retainers having spaced upwardly-extending opposite side walls, said side walls having a substantially continuous generally level uninterrupted upper surface, a slanted bottom wall for each retainer, a wedge-shaped elastomeric pad positioned within each retainer, each pad having a generally level top wall and a slanted bottom wall seated on said pad retainer slanted bottom wall, opposite sides of each pad having a wedge-shaped elongated slot extending generally along and spaced from a corresponding retainer side wall, said slots being generally intermediate the opposite ends of each pad, and a fastening member for maintaining each pad within a retainer welded to each side wall generally intermediate its ends and extending into a slot, said fastening members being generally L-shaped, with one side of the fastening member being welded to a retainer side wall and the other side extending along the top of the retainer side wall and into a pad slot, said slots having a length at least twice the width of a fastening member to permit variable positioning of the fastening member upon each side wall, but with full welding area of said fastening member one side to each side wall regardless of the vertical position of the pad within the retainer.

* * * * *